US006068331A

United States Patent [19]

Barnes

[11] Patent Number: 6,068,331

[45] Date of Patent: May 30, 2000

[54] STACKABLE AND NESTABLE ARTICLES OF FURNITURE

[76] Inventor: Paul Gregory Barnes, 1826 Beacon Ridge Rd., Charlotte, N.C. 28210

[21] Appl. No.: 09/178,032

[22] Filed: Oct. 20, 1998

[51] Int. Cl.[7] ..... A47B 7/02

[52] U.S. Cl. ..... 297/140; 297/440.13; 108/180

[58] Field of Search ..... 297/440.13, 140, 297/234; 108/180, 165

[56] References Cited

U.S. PATENT DOCUMENTS

| | | | |
|---|---|---|---|
| 1,735,851 | 11/1929 | Burton | 297/440.13 |
| 3,301,590 | 1/1967 | Young | 297/140 X |
| 4,433,753 | 2/1984 | Watson | 297/440.13 X |

FOREIGN PATENT DOCUMENTS

| | | | |
|---|---|---|---|
| 625553 | 8/1927 | France | 297/140 |
| 3905406 | 8/1990 | Germany | 108/180 |
| 669507 | 3/1989 | Switzerland | 108/180 |
| 495878 | 5/1938 | United Kingdom | 297/140 |

*Primary Examiner*—Peter M. Cuomo
*Assistant Examiner*—David E. Allred
*Attorney, Agent, or Firm*—William B. Noll

[57] ABSTRACT

Stackable and nestable articles of furniture comprising a pair of chairs and a pair of tables. The individual components may be used separately, such as by two children, or as a stacked and mated unit, essentially in the form of a cube, as an upstanding single unit.

9 Claims, 2 Drawing Sheets

STACKABLE AND NESTABLE ARTICLES OF FURNITURE

FIELD OF THE INVENTION

This invention is directed to the field of stackable articles of furniture which are nestable in a stored condition to form a useful cubic-like table arrangement.

BACKGROUND OF THE INVENTION

The present invention relates to stackable and nestable articles of furniture comprising a pair of chairs and a pair of tables. The invention has particular utility as a play and school work station for children for use in the child's room, where space may present a problem. Typically, toys and clothes fill the room, so space is at a premium. The invention hereof offers parents, for example, a convenient means to give their children a table top work station when desired, and a compact, nestable article that retains it utilitarian function for use or when stored.

From a review of the prior art nothing appear remotely related to the unique article of furniture of this invention. The prior art is best reflected in the following U.S. Patents:

a.) U.S. Pat. No. 5,765,922, to Hsia, relates to a portable combination chair including a seat member having a back slot, a left slot and a right slot, a back supporting member having a left connecting wing and a right connecting wing protruded at the two bottom side thereof, a right arm resting member having a rear slot, and a left arm resting member also having a rear slot. The back supporting member is assembled with the left and right arm resting members by inserting the left and right connecting wings through the two rear slots of the left and right arm resting members respectively, in which the bottom side of each connecting wing has a connecting groove indented thereon for engaging with the two rear slots of the left and right arm resting members. The seat member is assembled by inserting the back supporting member and the left and right arm resting members through the back slot, the left slot and the right slot respectively until a bottom surface of the seat member is rested on at least a supporting shoulder formed on the left and the right arm resting member. Thereby, the portable combination chair can help developing the creativity of the children and provide a stable and tightly constructed chair which can be disassembled and reassembled without affecting the desire connection strength.

b.) U.S. Pat. No. 5,011,228, to Marcantel, is directed to a knock-down collapsible article of furniture which, in a disassembled state, utilizes some of its components to interlock and create a storage package for the remainder of the components. In the disassembled state, two side panels operate in conjunction with a support member and a locking key to create a box or envelope that holds the remaining pieces of the article of furniture.

c.) U.S. Pat. No. 4,834,450, to Stickler, teaches a combined table and bench assembly for indoor and outdoor use, capable of being assembled and disassembled without tools. The component parts of the assembly fit together solely with interlocking notches and/or protrusions. The assembly is sturdy and will withstand rugged use. Yet, it is light enough to be easily transported. The parts of the assembly may be conveniently stored and transported in a compact wheeled carrier.

d.) U.S. Pat. No. 3,837,719, to Barron, relates to a collapsible desk and chair formed of paperboard, cardboard or the like. The desk is formed from a plurality of blanks which are secured together to provide a unitary construction. The connected blanks define a top member, a pair of side support members and an inner shelf member which can be folded together into a relatively flat configuration for storage, and which can be unfolded and erected to define a desk having a pivotable top member and inner and side shelves for storage. The chair is formed from a base member blank and a seat member blank which are secured together to provide a unitary construction, and a separate inner support member formed of a single blank. The seat member is pivotally connected to the base member, and the separate inner support member is foldable and receivable within the erected base member for the purpose of reinforcing it and is supported by connected foldable flaps on the lower portion of the base member.

e.) U.S. Pat. No. 2,456,111, to Creech, is directed to a child's knockdown chair and table which may be knocked down and reassembled without tools. Further, the parts thereof are in such proportions that when disassembled may fit together and be inserted into a carrying case.

f.) U.S. Pat. No. 2,109,869, to Ross, teaches a table and chair assembly wherein a rack or guide rail formation is formed within the confines of the table for supporting and maintaining the chairs therein, when the latter are not in use. The table is so formed and the rack assembly therein is so disposed as to substantially conceal the chairs when maintained therein, except at the ends.

While the above prior art offer a variety of furniture items, none illustrate the type of stackable and matable articles of furniture as taught herein. The manner by which the present invention distinguishes from this prior art will become apparent to those skilled in the art from the following specification, particularly when read in conjunction with the accompanying drawings.

SUMMARY OF THE INVENTION

The invention hereof relates to stackable and matable articles of furniture having two operable modes of use. The invention comprises a pair of essentially identical, matable table members, where each table member comprises a planar table top and a pair of parallel, spaced-apart support members secured to the underside of the table top. A first support member is "T" shaped with the horizontal leg secured to the underside of the table top. A second support member is "C" shaped with the intermediate leg thereof secured to the underside of the table top. The spacing between the remaining or free legs is sized to slidably receive the vertical leg of the "T" shaped support member of the other table member in the stacked and mated mode. Additionally, the invention includes a pair of reversibly stackable chairs having a width to be slidably positioned between the respective pairs of support members.

In the unstacked mode the individual articles are particularly suitable for children and readily movable by them to a convenient location. However, in the stacked and mated mode, a single and stable table unit is realized.

Accordingly, an object of this invention is to provide a unique article of furniture consisting of a pair of tables and a pair of chairs, particularly suited for use by children as individual components, but which, when stacked and mated, converts to an adult table unit.

Another object hereof is the provision of a series of light weight articles of furniture that can be readily stacked and mated to form a single stable furniture unit.

These and other objects will become more apparent from a reading of the following description.

DETAILED DESCRIPTION OF PREFERRED EMBODIMENT

The present invention is directed to stackable and nestable articles of furniture that have utility in either the stacked and nested mode, but also as separate furniture articles.

Figure 1:
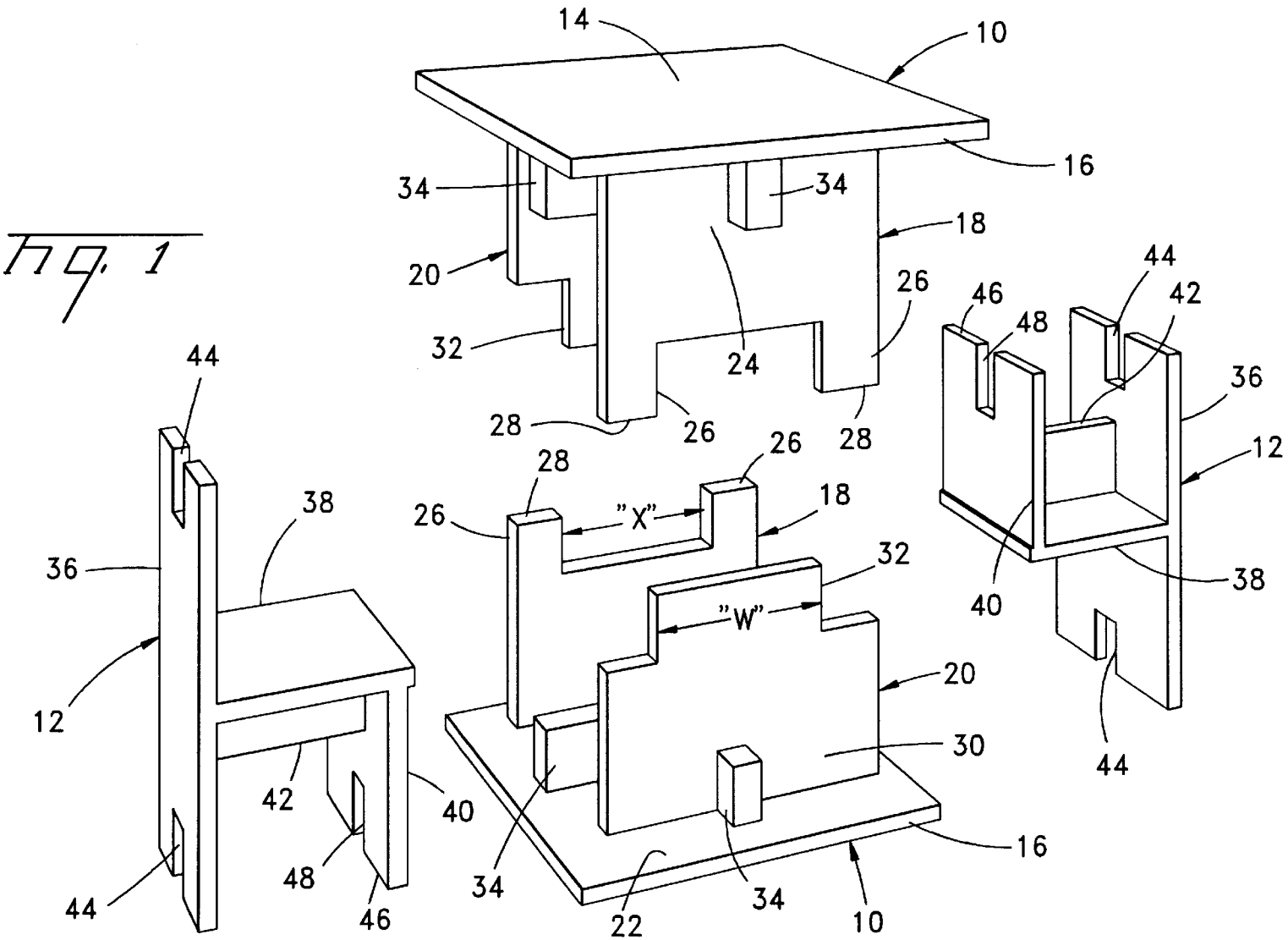
FIG. 1 is an exploded perspective view of a preferred embodiment for stackable and nestable articles of furniture according to this invention, showing a pair of tables, one reversed, and a pair of chairs, one reversed, positioned to be stacked and mated.

The invention will now be described with reference to the two Figures, where like reference numerals represent like components or features in the two views. FIG. 1 illustrates a preferred embodiment for the several articles forming the invention hereof. The invention comprises a pair of identically constructed table members 10 and a pair of essentially identical chair members 12, formed of wood panels or molded of light weight plastic.

Each table member 10 comprises a planar table top 14, preferably rectangular in configuration and defined by peripheral edges 16, and a pair of parallel, spaced-apart support members 18, 20, where said support members are secured to the underside 22 of the table top 14, preferably inwardly from a peripheral edge 16.

The respective support members 18, 20 of a first table member are designed and configured to slidable mate with a comparable support member of the second table member. The support member 18, as best seen in FIG. 1, is "C" configured, where the intermediate leg 24 is secured to said underside 22, while the remaining two legs 26 extend perpendicular from said table top 14. The free ends 28 are the contact support surfaces for the table member 10, when used as an individual unit. Finally, the respective two legs 26 are spaced apart a distance "X", for reasons to become apparent hereafter.

The companion or support member 20 is "T" configured. The latter support member consists of a generally horizontal leg 30, secured to said underside 22, and a generally vertical leg 32 extended perpendicular therefrom. The width "W" of vertical leg 32 is sized slightly less than the distance "X" so as to be slidably received between the two legs 26, see FIG. 1. To provide added stability to the table members 10, a pair of crossed ribs 34 may be added to the underside 22.

The chair members 12 are essentially identical in shape and construction. Each said chair member comprises a planar back panel 36, a seat panel 38, and a front support 40. For stability, the chair member 12 may include a lateral support 42 secured to the seat panel 38 and extending between the back panel and front support. Additionally, each end of the planar back panel 36 is provided with a slot 44 of a size to slidably override a rib 34, as hereafter explained. Also, as seen in FIG. 1, the free end 46 of the front support 40 is provided with a comparable rib receiving slot 48.

Figure 2:
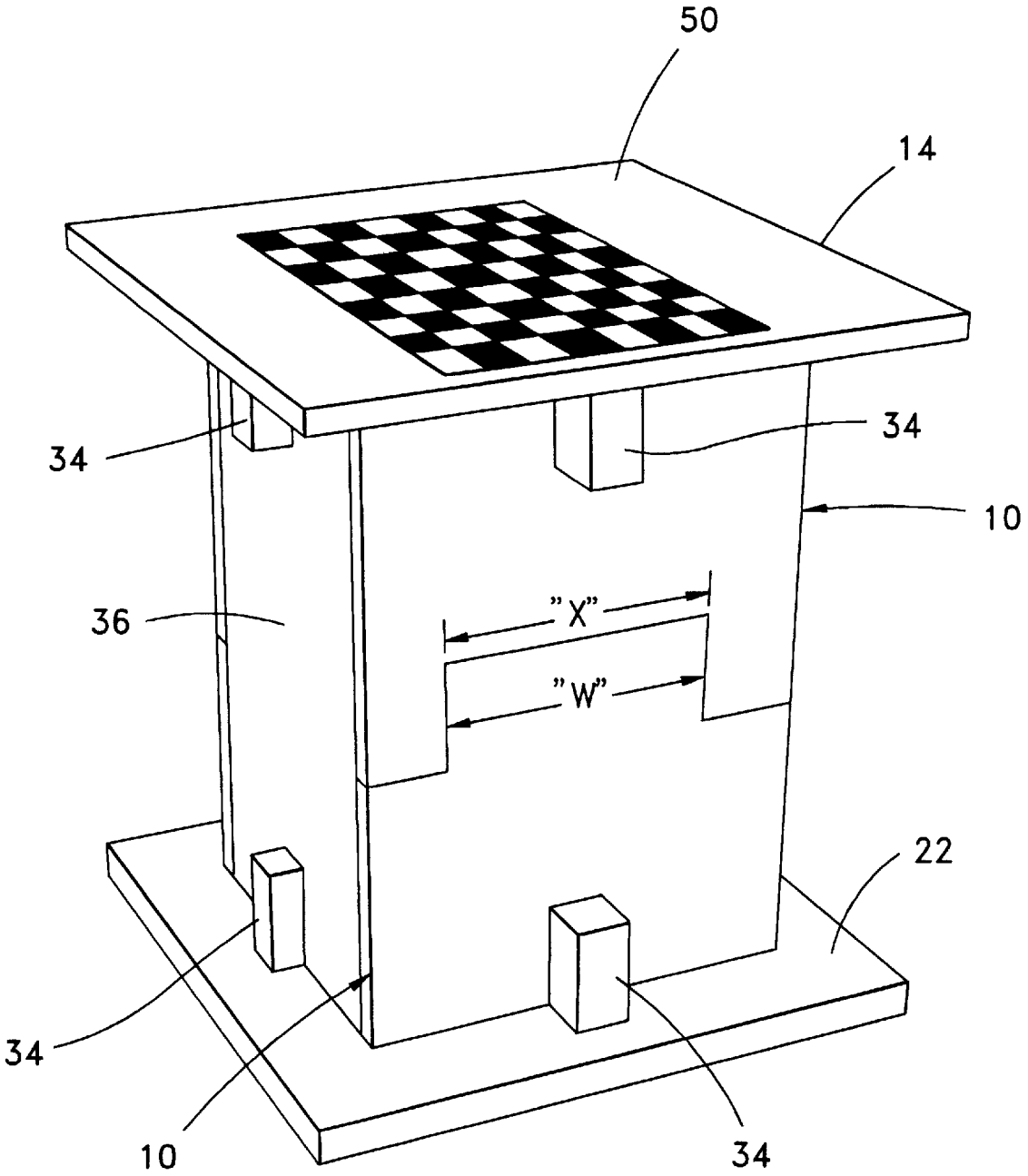
FIG. 2 is a perspective view of the stacked and mated articles of FIG. 1, illustrating a second use for such articles as a table.

Except for the fact that one table member 10 (lower most component) and one chair member 12 (right component) are up-side down, FIG. 1 illustrates the individual components as they might be used by children, for example. However, there comes a time when the respective components must be stacked to make room, or there is need for a larger table unit. To stack and mate such components, a first said table member 10 is positioned up-side down on the floor. Thereafter, a first of the two chair members 12 (left component of FIG. 1) is positioned on the underside 22 between the pair of support members 18, 20, with the appropriate slots 44, 48 overriding the ribs 34. The second chair member 10, positioned up-side down, as shown in the right in FIG. 1, is positioned between the support members 18, 20, where the respective seat panels 38 lie contiguous with one another. Finally, with the chair members so positioned, the remaining table member 10 may be seated over the chair members to rest on and mate with the first table member. When properly stacked and mated, the assembly will appear as shown in FIG. 2. With this assembly, a larger table unit is provided. As an enhancement to the system hereof, one or both of the the top surfaces 50 of of the table top 14 may be provided with a selected game board, for example, with appropriate markings or indicia for the selected game. As seen in FIG. 2, the table top may include a checker board pattern for games to be played thereon. The table top pattern may be fixed on the table top 50 by printing, laminating, in-situ molding, adhesives, or by other means known in the art. This makes game playing more of a pleasure for children, for instance, and minimizes clean-up and pick-up for parents, requiring only storage of the game pieces.

While the invention has been described in a preferred form, it will be understood that changes, additions, and modifications may be made to the respective articles forming the invention hereof. Accordingly, no limitation should be imposed on this invention, except as set forth in the accompanying claims.

I claim:

1. Stackable and nestable articles of furniture comprising:

a. a pair of essentially identical and matable table members, each said table member comprising a planar table top, and a pair of parallel, spaced-apart support members secured to the underside of said table top, where a first said support member is "T" shaped with the horizontal leg being secured to said table top, and a second said support member is "C" shaped with the intermediate leg being secured to said table top, and the spacing between said remaining legs of said C-shape sized to slidably receive the vertical leg of said first support member, and a b. a pair of reversibly stackable chairs having a width of a size to be slidably received between said parallel, spaced-apart support members such that in a completely nested configuration, said chairs are stacked and received between said support members and said table members are inverted and stacked relative to each other.

2. The stackable and nestable articles of furniture according to claim 1, wherein each said table top underside includes at least one upstanding support rib, and that each said chair includes a slot at an end thereof to receive said support ribs in a stacked and nested condition.

3. The stackable and nestable articles of furniture according to claim 2, wherein there are a pair of intersecting said ribs.

4. The stackable and nestable articles of furniture according to claim 1, wherein said table tops are rectangular in configuration and defined by peripheral edges, and said support members are spaced inwardly from said peripheral edges.

5. The stackable and nestable articles of furniture according to claim 1, wherein each said chair includes a seat panel extending laterally from an elongated planar member, said planar member having a length essentially equal to a pair of said support members in a nestable position.

6. The stackable and nestable articles of furniture according to claim 5, wherein planar members include said slot being an intermediate slot at each end thereof.

7. The stackable and nestable articles of furniture according to claim 5, wherein said seat panel further includes an edge support member parallel to and spaced from said elongated planar member.

8. The stackable and nestable articles of furniture according to claim 7, wherein each said edge support member includes a free end having an intermediate slot.

9. The stackable and nestable articles of furniture according to claim 1, wherein at least one said table top includes markings and indicia representing a game board.

* * * * *